US009042743B2

(12) United States Patent
Sakurai

(10) Patent No.: US 9,042,743 B2
(45) Date of Patent: May 26, 2015

(54) PRINTER

(75) Inventor: Hiroshi Sakurai, Tokorozawa (JP)

(73) Assignee: CITIZEN HOLDINGS COMPANY, LTD., Tokyo (JP)

( * ) Notice: Subject to any disclaimer, the term of this patent is extended or adjusted under 35 U.S.C. 154(b) by 1098 days.

(21) Appl. No.: 12/529,289

(22) PCT Filed: Feb. 27, 2008

(86) PCT No.: PCT/JP2008/053414

§ 371 (c)(1),
(2), (4) Date: Aug. 31, 2009

(87) PCT Pub. No.: WO2008/117617

PCT Pub. Date: Oct. 2, 2008

(65) Prior Publication Data

US 2010/0074635 A1 Mar. 25, 2010

(30) Foreign Application Priority Data

Mar. 26, 2007 (JP) ..... 2007-079858

(51) Int. Cl.
*B41J 11/46* (2006.01)
*B41J 3/407* (2006.01)

(52) U.S. Cl.
CPC ..... *B41J 11/46* (2013.01); *B41J 3/4075* (2013.01)

(58) Field of Classification Search
CPC ..... B41J 11/46; B41J 3/4075; B41J 29/393; B65H 26/00; B65H 26/06; B65H 2511/516; B65H 26/066
USPC ..... 399/16, 18; 400/613, 88, 611; 101/DIG. 46
See application file for complete search history.

(56) References Cited

U.S. PATENT DOCUMENTS

| | | | | |
|---|---|---|---|---|
| 4,161,899 | A * | 7/1979 | Strunc | 83/371 |
| 4,734,868 | A * | 3/1988 | DeLacy | 358/1.12 |
| 7,364,251 | B2 | 4/2008 | Arakawa et al. | |
| 2005/0035989 | A1 | 2/2005 | Arakawa et al. | |

FOREIGN PATENT DOCUMENTS

| | | |
|---|---|---|
| JP | 61-254367 | 11/1986 |
| JP | 4-275172 | 9/1992 |

(Continued)

OTHER PUBLICATIONS

Chinese Office Action issued Dec. 24, 2010 for Application No. 200880000999.2 with English language translation.

(Continued)

*Primary Examiner* — Judy Nguyen
*Assistant Examiner* — Jennifer Simmons
(74) *Attorney, Agent, or Firm* — Smith, Gambrell & Russell LLP

(57) ABSTRACT

A printer for printing a continuous sheet with position detection marks has a mark detection function and a feed amount detection function that are normally enabled. Further, the printer is provided with a mechanism that operates in a sheet feed mode (mark detection mode) that utilizes the mark detection function and a sheet feed mode (feed amount detection mode) that utilizes the set feed amount detection function. If the mark detection function suffers an error, the sheet feed mode is switched from the mark detection mode to the feed amount detection mode, and a printing operation is continued.

4 Claims, 3 Drawing Sheets

(56) References Cited

FOREIGN PATENT DOCUMENTS

| | | |
|---|---|---|
| JP | 4-323071 | 11/1992 |
| JP | 4-347670 | 12/1992 |
| JP | 5-84995 | 4/1993 |
| JP | 7-196237 | 8/1995 |
| JP | 8-2034 | 1/1996 |
| JP | 2002-205872 | 7/2002 |
| JP | 2005-231053 | 9/2005 |

OTHER PUBLICATIONS

International Search Report.

* cited by examiner

PRINTER

TECHNICAL FIELD

The present invention relates to a printer for a continuous sheet with position detection marks for sheet feed.

BACKGROUND ART

For printers that print labels or tags or repeatedly print data on a conventional continuous sheet for each of predetermined divisions to prepare paper slips, the sheet position must be accurately grasped so that the labels, tags, or predetermined divisions of the continuous sheet can be printed appropriately. Therefore, a continuous sheet with position detection marks is used in the printing of this type. The marks on this continuous sheet may be black marks, holes, or notches. In the case of a continuous sheet such as a label sheet, in which labels are arranged at regular intervals on a mount, on the other hand, the marks may be gaps between the labels. Many of these marks are configured to vary received light outputs from photoelectric elements.

If a sheet position detection sensor fails to detect a position detection mark during a printing operation for any reason, according to the printer of the type described above, it is concluded that a sheet position detection error has occurred, and the printing operation is stopped thereafter. Specifically, if the sheet position detection sensor can normally detect none of the marks due to a probably instantaneous unexpected cause, such as disturbance light, defective printing of black marks, defective perforation, etc., the printing operation of the printer is inevitably interrupted (even though the next mark may have been normally detected).

While printers that print a continuous sheet with position detection marks are described in the following patent documents, none of them deal with the aforementioned problems.

A printer that prints a label sheet is described in, for example, Japanese Patent Application Laid-Open No. 07-196237. This printer is designed so that the presence of the label sheet itself and printing positions on labels are detected by using a single sheet detection means (or sensor), whereby the equipment costs and production costs can be reduced.

Another printer that prints a label sheet is described in Japanese Patent Application Laid-Open No. 04-323071. This printer is designed to solve a problem associated with the timing of origination of a status signal for a "paper end error". Even if the error signal is inputted while the label sheet is being printed, the status signal for the "paper end error" is originated to stop the printing operation after the label printing is finished, without stopping the printing operation on the spot.

Described in Japanese Patent Application Laid-Open No. 04-347670 is a system for preventing paper jam that is peculiar to label sheets by stopping issuance (printing) of labels if no label sheet is detected by a sensor while a cutter is being operated.

Printers described in Japanese Patent Applications Laid-Open Nos. 04-275172, 05-084995 and 2002-205872 can use both ordinary continuous sheets without position detection marks and label sheets (each formed of a continuous mount and a plurality of labels thereon). In these printers, a sheet feed mode is established by automatically making discrimination between ordinary continuous sheets and label sheets, so that it is unnecessary to manually reset the printers with every change of the sheet type.

DISCLOSURE OF THE INVENTION

The object of this invention is to provide a printer for printing a continuous sheet with position detection marks, capable of continuing a printing operation even when a sheet position detection sensor fails to detect a position detection mark for some reason.

A printer according to the present invention for printing a continuous sheet with position detection marks has a function (mark detection function) to detect the position detection marks and a function (set feed amount detection function) to detect a set sheet feed amount and is configured to operate in a sheet feed mode (mark detection mode) that utilizes the mark detection function and a sheet feed mode (feed amount detection mode) that utilizes the set feed amount detection function.

In the mark detection mode, gaps between labels or marks on a continuous sheet, such as a label sheet or tag sheet, are detected by means of a mark detection sensor. Printing is performed with the continuous sheet located in a printing position based on a mark position obtained as a result of the detection by the mark detection sensor. In the feed amount detection mode, on the other hand, printing is performed with the continuous sheet located in the printing position based on a sheet feed amount depending on a predetermined unit sheet length.

The mark detection function and the set feed amount detection function are normally enabled during a printing operation. If the mark detection function suffers an error, a control section of the printer switches the sheet feed mode for printing from the mark detection mode to the feed amount detection mode. By doing this, the control section of the printer continues the printing operation without interruption.

If a mark is detected while the sheet is being fed in the feed amount detection mode, the control section immediately switches the sheet feed mode from this feed amount detection mode to the mark detection mode. The printing operation is stopped, however, if the sheet feed in the feed amount detection mode is continued without detection of any mark so that a feed distance several times as great as a mark-to-mark feed amount (sheet length) is covered. This is because if the sheet feed in the feed amount detection mode continues, errors with respect to an actual sheet feed amount may be accumulated due to slippage or the like in a sheet traveling route, and in some cases, out-of-paper may fail to be detected.

Since the mark detection mode and the feed amount detection mode are simultaneously enabled, according to this invention, the first cycle of printing operation after the printer is started is performed in such a manner that the continuous sheet is located in the printing position, based on the result of detection of the mark position in the mark detection mode or detection of the unit sheet length in the feed amount detection mode, whichever may be earlier. Thereafter, the printing operation may be directly advanced in the mode based on the result of earlier detection. Alternatively, if a mark is detected as aforementioned, the mode may be switched to the mark detection mode.

According to the printer of the present invention, the printing operation can be prevented from being interrupted due to a failure of mark detection during the continuous sheet printing operation.

Normally, the printing operation is performed with the continuous sheet fed in the mark detection mode. If the detection of the position detection marks suffers an error for any reason during the printing operation, the mark detection mode is immediately switched over to the feed amount detection mode, whereupon the sheet is fed in the feed amount detection mode and the printing operation is continued. Thus, according to the present invention, the printing operation is not interrupted, so that the operating efficiency for printing is improved. Further, the mark detection mode is restored immediately when any of the position detection marks is detected while the sheet is being fed in the feed amount detection mode, so that the accuracy of the sheet feed can be maintained.

The continuous sheet is located in the printing position based on the result of preceding detection, and the subsequent printing operation is set to be advanced directly in the precedently detected mode. If this is done, this printer makes a self-judgment as to whether to print an ordinary continuous sheet without detection marks or print a continuous sheet with detection marks.

BEST MODE FOR CARRYING OUT THE INVENTION

Figure 1:
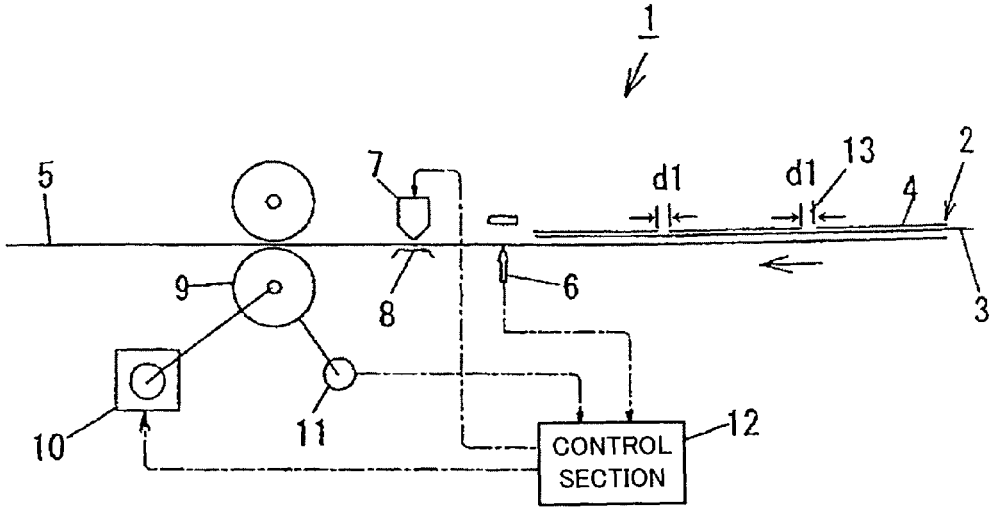
FIG. 1 is a schematic view of one embodiment of a printer according to the present invention.

FIG. 1 typically shows only principal parts of a printer 1 according to one embodiment of the present invention. In this printer 1, a continuous sheet 2 with position detection marks is a label sheet, which is formed of a continuous mount 3 and labels 4 that are arranged at regular intervals (gaps) d1 on top of the mount 3. A traveling route 5 for the continuous sheet 2 in the printer 1 is represented by a straight line.

Figure 2:
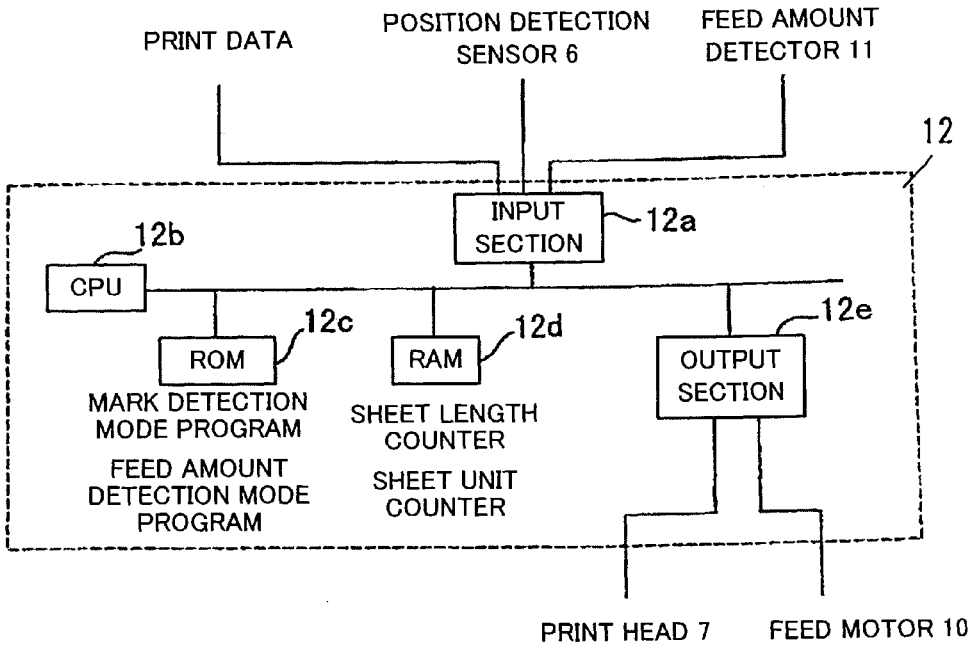
FIG. 2 is a diagram for illustrating the function of a control section of the printer of FIG. 1.

A position detection sensor 6, print head 7, platen 8, and feed roller 9 are individually arranged along the traveling route 5. The feed roller 9 is driven by a feed motor 10, and its rotation amount, that is, sheet feed amount, is detected by a feed amount detector 11. As shown in FIG. 2, the printer 1 is provided with a control section 12, and an output of the position detection sensor 6 and an output of the feed amount detector 11 are fetched into an input section 12*a* of the control section 12 with every basic control cycle and recorded in a RAM 12*d* of the control section 12. As the position detection sensor, a transmission optical sensor is used in detecting notches or holes, and a reflective optical sensor is used in detecting black marks.

The feed motor 10 and the print head 7 are connected to an output section 12*e* of the control section 12 through their respective drivers, and are controlled and driven by the control section 12. Print data is inputted from outside the printer 1. The print data is transmitted to the driver of the print head 7 through the output section 12*e* of the control section 12. The RAM 12*d* is provided with regions for a sheet length counter and a sheet unit counter for recording the output from the feed amount detector 11 as the feed amount. The sheet unit counter counts a unit sheet length d2 (mentioned later) as a unit.

A ROM 12*c* is loaded with a program for a mark detection mode (mentioned later), a program for a feed amount detection mode, and other required programs for a printing operation. A CPU 12*b* integrally controls the printing operation en bloc based on these programs and set parameters. The processing itself that is performed by the CPU 12*b* is not particularly different from the processing which is performed by the CPU 12*b* of a controller in a conventional printer.

Figure 3A:
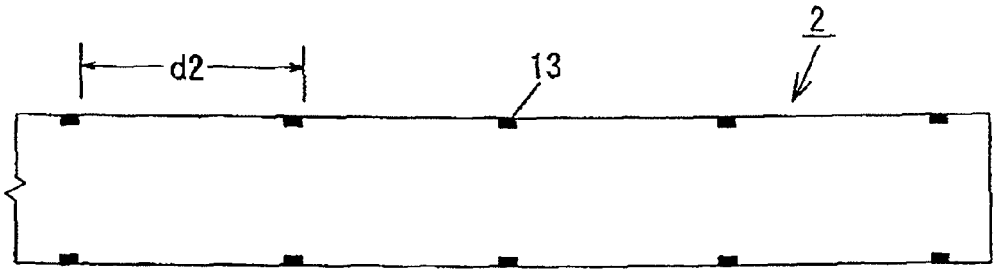
FIG. 3A is a plan view showing a first example of a continuous sheet with position detection marks.
Figure 3B:
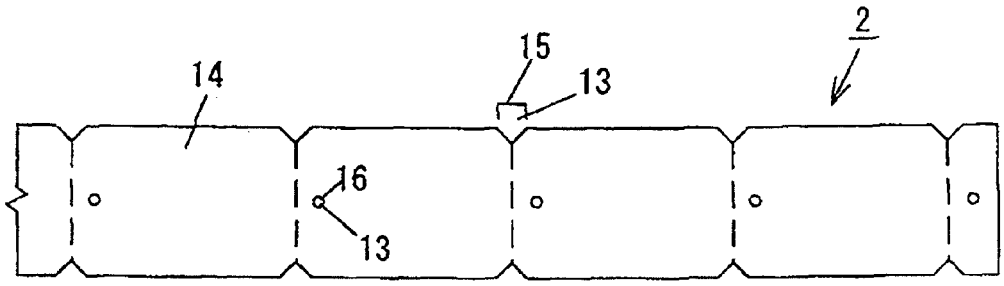
FIG. 3B is a plan view showing a second example of the continuous sheet with position detection marks.
Figure 3C:
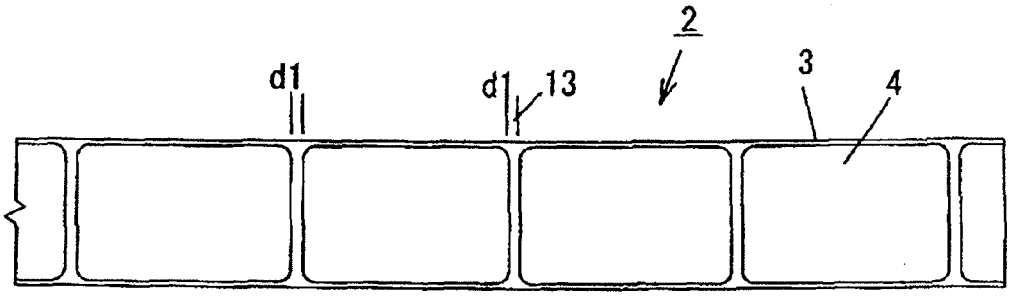
FIG. 3C is a plan view showing a third example of the continuous sheet with position detection marks.

FIGS. 3A to 3C individually show examples of position detection marks on each continuous sheet 2.

In the case of the continuous sheet 2 shown in FIG. 3A, position detection marks 13 are black marks, which are printed at regular intervals d2 on that surface of the continuous sheet which is free of printing. After the printing, this continuous sheet 2 is cut at the regular intervals into pieces to be used as receipts or paper slips. Each interval (interval between the marks) d2 is equal to an amount of feed between the marks covered in each cycle of printing operation or the length of the sheet used (sheet length). In view of the entire continuous sheet, the interval d2 can be said to be the unit sheet length as a unit of the printing operation.

In the case of the continuous sheet 2 shown in FIG. 3B, the position detection marks 13 are triangular notches 15. This continuous sheet 2 is formed of tags 14 that are continuous with one another. The tags 14 can be individually cut along perforations. The triangular notches 15 as the position detection marks 13 are formed at border spots between the tags so as to be situated on the opposite sides, left and right, of the continuous sheet 2 with respect to the sheet feed direction. Further, a threading eyelet 16 is formed in the central part of each tag 14 and on the slightly downstream side with respect to the sheet feed direction. The eyelets. 16 can be also utilized as the position detection marks 13.

In the case of the continuous sheet 2 shown in FIG. 3C, the position detection marks 13 are gaps between labels 4. This continuous sheet 2 is a label sheet formed of a continuous mount 3 and the plurality of labels 4 that are arranged at regular intervals on top of the mount 3. Gaps for intervals d1 exist between the labels 4, and these regions are formed only of the mount 3. In this label sheet, these gaps can be used as the position detection marks 13. If the position detection sensor is of, for example, a photoelectric type, the amount of transmitted light at the gap portions between the labels 4 is different from that at the positions of the labels 4, so that the positions of the gaps can be located by using a threshold value or the like.

An operation that is executed by the CPU 12*b* of the control section 12 will now be described with reference to the flowchart of FIG. 4.

If the printer 1 with the continuous sheet 2 shown in FIG. 3A set therein is driven, the CPU 12*b* reads the programs in the ROM 12*c*, and first resets the sheet length counter and the sheet unit counter in Step s1. The unit sheet length d2 of the continuous sheet 2 used is previously inputted and set in a predetermined region of the RAM 12*d*.

[Position Detection Operation]

In Step s2, the feed motor 10 is driven, and at the same time, the sheet length counter starts to count the sheet feed amount.

In Step s3, whether or not any of the position detection marks 13 is detected is determined. Since none of the position detection marks 13 can be detected yet at the start of sheet feed, the program proceeds to Step s9, in which it is determined whether or not the set unit sheet length d2 is attained by the value in the sheet length counter. Since the set unit sheet length d2 is not yet attained by the value in the sheet length counter at the start of the sheet feed (decision in Step s9 is no), the program returns from here to Step s2. Thereafter, processing of Step s3-Step s9-Step s2-Step s3 (processing in a position detection loop) is repeatedly executed until any of the position detection marks 13 is detected (or the decision in Step s3 becomes yes) as the sheet is fed.

[Operation in Mark Detection Mode]

If any of the position detection marks 13 is detected while the position detection loop processing (Step s3-Step s9-Step s2-Step s3) is being thus repeatedly executed (decision in Step s3 is yes), the sheet unit counter is reset in Step s4, the sheet length counter is reset in Step s5, and moreover, printing is started in Step s6. In the printing operation, which is the same as the conventional one, the continuous sheet 2 is fed to a print start position based on the position of the position detection mark 13, and printing is started at this position. A region of the unit sheet length (range of a sheet of label) is printed in Step s6, and the program proceeds to Step s7 when a print end signal is obtained.

In Step s7, it is determined whether or not a programmed number of labels are all printed. If the printing is not finished yet (decision of Step s7 is no), the program returns to Step s2, whereupon the next printing operation is started. The processing of Step s3-Step s4-Step s5-Step s6-Step s7-Step s2-Step s3 (printing operation in the mark detection mode) is repeatedly executed until it can be concluded that the printing on the programmed number of labels is finished.

This printing operation (repeated processing of Step s3-Step s4-Step s5-Step s6-Step s7-Step s2-Step s3) in the mark detection mode is executed repeatedly. When the printing on the programmed number of labels is finished (decision in Step s7 is yes), the program proceeds to Step s8, in which the feed motor 10 is stopped. Thereupon, the printing operation is finished. A sheet counting system is separately used to determine whether or not the programmed number is attained by the printed labels. A conventional sheet counting system may be used for this purpose.

If the marks cease to be detected in Step s3 during the execution of the printing operation (repeated processing of Step s3-Step s4-Step s5-Step s6-Step s7-Step s2-Step s3) in the mark detection mode, the program gets out of the loop for the mark detection mode and proceeds to Step s9. If the unit sheet length d2 is not yet attained by the feed amount of the continuous sheet (decision in Step s9 is no), the program proceeds to Step s2. Thus, the aforementioned processing of the position detection loop (Step s3-Step s9-Step s2-Step s2) is repeatedly executed as long as a mark is not detected and the unit sheet length d2 is not attained by the feed amount of the continuous sheet.

The unit sheet length d2 is attained by the feed amount of the continuous sheet (decision in Step s9 is yes) as the processing of the position detection loop is repeated without detection of a supposedly existing mark for some reason (decision in Step s3 is no). Thereupon, the program proceeds from Step s9 to Step s10.

[Operation in Feed Amount Detection Mode]

The sheet unit counter counts 1 in Step s10, and it is determined in Step s11 whether or not the count value of the sheet unit counter is 3 in consequence. If the count value is not yet 3, processing (printing operation in the feed amount detection mode) of Step s5-Step s6-Step s7 (decision in this step is no, since the programmed printing is not completed)-Step s2-Step s3 (decision in this step is no, since no mark is detected yet)-Step s9-Step s10-Step s11 is repeatedly executed. This printing operation in the feed amount detection mode is not a printing operation performed based on a mark which was detected but a printing operation performed based on a feed amount (unit sheet length) which was detected.

If the printing operation in the feed amount detection mode (repeated processing of Step s5-Step s6-Step s7-Step s2-Step s3-Step s9-Step s10-Step s11) is thus continuously executed twice without detection of any mark (decision in Step s3 is no), the count value of the sheet counter becomes 3 in Step s11. In consideration of slippage of the sheet in the traveling route 5, in such a situation, the possibility of printing being performed thereafter in a correct position is supposed to be low, so the program gets out of the loop for the feed amount detection mode and proceeds from Step s11 to Step s12, in which a sheet detection error is displayed. Then, the program proceeds to Step s8, in which the feed motor is stopped to interrupt the printing operation. The printing operation is also interrupted in case of out-of-paper.

Figure 4:
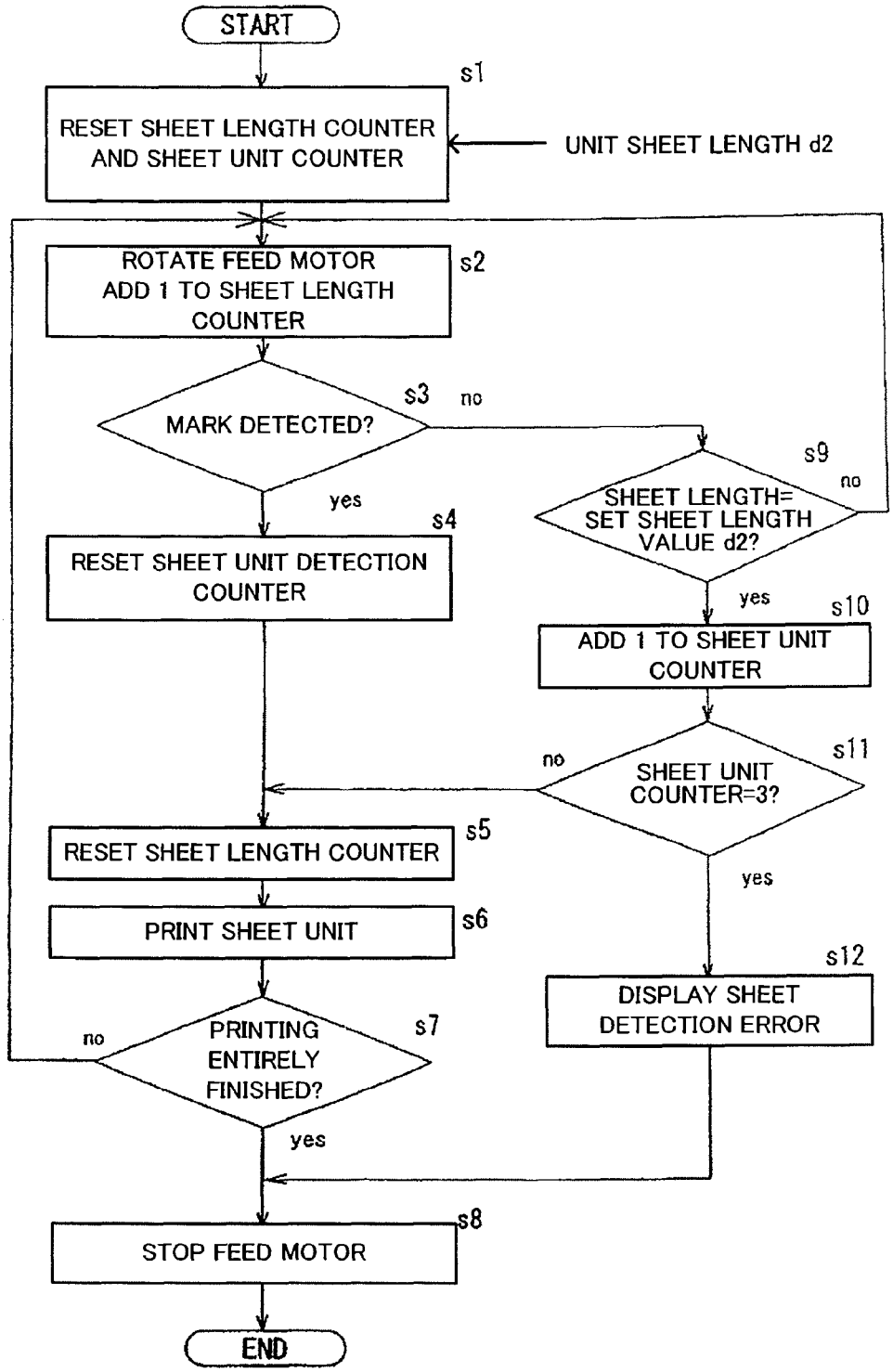
FIG. 4 is a flowchart for illustrating operating procedure executed by a CPU of the control section shown in FIG. 2.

In the processing flow shown in FIG. 4, as mentioned before, the printing operation as a whole is executed based on the position detection marks 13 of the continuous sheet as long as the position detection marks 13 continue to be normally detected (mark detection mode). If the position detection marks 13 cease to be able to be detected for any reason, however, the programs gets out of the loop for the mark detection mode and enters the loop for the feed amount detection mode (Step s3 to Step s9), whereupon a unit sheet length position is detected. The printing operation is executed based on the detected position (feed amount detection mode). If a mark is detected again while printing is being performed in the feed amount detection mode, the program gets out of the loop for the feed amount detection mode and enters the loop for the original mark detection mode (Step s3 to Step s4), whereupon the printing operation is normally executed based on the position detection marks 13. If the mark is not readily detected while printing is performed in the feed amount detection mode (e.g., if no mark is detected even when the sheet is fed for a distance equivalent to twice the unit sheet length), on the other hand, the printing operation is interrupted for safety.

In the embodiment described above, the printing operation in the feed amount detection mode is continuously executed in place of the printing operation in the mark detection mode unless a feed distance several times as long as a predetermined unit sheet length is covered, so that the printing operation is never interrupted even if no mark is detected once or twice.

Although the value (criterion) in the sheet unit counter is set to be 3 in Step s11 according to the embodiment, it can be properly set according to circumstances.

While it is determined in Step s9 whether or not the unit sheet length is attained by the value in the sheet length counter according to the embodiment, it may also be determined in Step s9 whether or not no mark is detected although the unit sheet length (mark-to-mark feed amount) is only exceeded by a set value f1. The value f1 is a value that is properly set in consideration of slippage of the sheet or the like, and is set to, for example, 5 mm. If the value f1 is set, the printing position is obtained by a calculation program which takes this value f1 into account.

The invention claimed is:

1. A printer for printing labels or tags on a continuous sheet having a surface with position detection marks located at regular intervals thereon, each interval being a unit sheet length used in the printing, said printer comprising:

a print head for printing the labels or tags in a region on the continuous sheet within the unit sheet length;

a feed roller for feeding the continuous sheet to the print head;

a feed motor for driving the feed roller;

a feed amount detector for detecting a feed amount of the continuous sheet fed by the feed roller;

a mark detection sensor for detecting the marks on the continuous sheet and providing an output indicating detection of a mark; and a control section for controlling the feed motor to drive the feed roller to feed the continuous sheet to a printing position and the print head to carry out a printing operation with the continuous sheet located in the printing position initially according to a mark detection mode in which the control section resets the feed amount detector and causes the print head to print in response to an output indicating detection of the mark by the mark detection sensor, and, thereafter, conditionally, according to a feed amount detection mode in which the control section causes the feed motor to drive the feed roller to feed the continuous sheet by the unit sheet length and then causes the print head to print in response to detection by the feed amount detector that the continuous sheet has been fed by the unit sheet length, the control section, in the mark detection mode, identifying a mark detection error, as a condition for controlling according to the feed detection amount mode, if the mark detection sensor fails to detect a mark after the feed amount detector has detected feeding of the continuous sheet by the unit sheet length, and thereafter switching controlling of the print head in the printing operation from the mark detection mode to the feed amount detection mode so as to continue the printing operation in response to identification of a mark detection error, restoring the mark detection mode to thereby continue the printing operation if a mark is detected by the mark detection sensor after the controlling has been switched from the mark detection mode to the feed amount detection mode, and displaying a sheet detection error and stopping the printing operation if the continuous sheet has been fed by the unit sheet length a predetermined number of times without detection of the mark by the mark detection sensor after the controlling has been switched from the mark detection mode to the feed amount detection mode.

2. A printer for printing labels or tags on a continuous sheet having a surface with position detection marks located at regular intervals thereon, each interval being a unit sheet length used in the printing, said printer comprising:

a print head for printing the labels or tags in a region on the continuous sheet within the unit sheet length;

a feed roller for feeding the continuous sheet to the print head;

a feed motor for driving the feed roller;

a feed amount detector for detecting a feed amount of the continuous sheet fed by the feed roller;

a mark detection sensor for detecting the marks on the continuous sheet and providing an output indicating detection of a mark; and a control section for controlling the feed motor to drive the feed roller to feed the continuous sheet to a printing position and the print head to carry out a printing operation with the continuous sheet located in the printing position initially according to a mark detection mode in which the control section resets the feed amount detector and causes the print head to print in response to an output indicating detection of the mark by the mark detection sensor, and, thereafter, conditionally, according to a feed amount detection mode in which the control section causes the feed motor to drive the feed roller to feed the continuous sheet by the unit sheet length and then causes the print head to print in response to detection by the feed amount detector that the continuous sheet has been fed by the unit sheet length, the control section, in the mark detection mode, identifying a mark detection error, as a condition for controlling according to the feed detection amount mode, if the mark detection sensor fails to detect another mark after the feed amount detector has detected a feed amount of the continuous sheet corresponding to the unit sheet length beyond a position at which a preceding mark was detected is exceeded by a preset value, and thereafter switching controlling of the print head in the printing operation from the mark detection mode to the feed amount detection mode so as to continue the printing operation in response to identification of a mark detection error, restoring the mark detection mode to thereby continue the printing operation if a mark is detected by the mark detection sensor after the controlling has been switched from the mark detection mode to the feed amount detection mode, and displaying a sheet detection error and stopping the printing operation if the continuous sheet has been fed by the unit sheet length a predetermined number of times without detection of the mark by the mark detection sensor after the controlling has been switched from the mark detection mode to the feed amount detection mode.

3. The printer according to claim 1 or 2, wherein the continuous sheet is a continuous label or tag, and the mark is a through hole or notch formed in the continuous label or tag.

4. The printer according to claim 1 or 2, wherein said mark is a gap between the labels or tags.

* * * * *